US005277536A

United States Patent [19]

Baldwin et al.

[11] Patent Number: 5,277,536

[45] Date of Patent: Jan. 11, 1994

[54] CO-MINGLED MATERIAL RECOVERY APPARATUS FOR RECYCLING

[76] Inventors: Kevin L. Baldwin; Michael L. Baldwin, both of P.O. Box 209, Eaton Rapids, Mich. 48827

[21] Appl. No.: 801,489

[22] Filed: Dec. 2, 1991

[51] Int. Cl.[5] ..... B65F 3/00

[52] U.S. Cl. ..... 414/409; 414/404

[58] Field of Search ..... 414/404, 406, 409, 498, 414/508, 679; 296/181, 182

[56] References Cited

U.S. PATENT DOCUMENTS

| | | | |
|---|---|---|---|
| 3,451,573 | 6/1969 | Josephian | 296/182 X |
| 4,310,279 | 1/1982 | Johnston | 414/406 X |
| 4,642,007 | 2/1987 | Marshall et al. | 296/182 X |
| 4,708,572 | 11/1987 | Kölker | 296/181 X |
| 5,018,929 | 5/1991 | Carson | 414/409 X |

FOREIGN PATENT DOCUMENTS

| | | | |
|---|---|---|---|
| 8602515 | 5/1988 | Netherlands | 414/498 |

OTHER PUBLICATIONS

SAC 1800 Literature, SAC Recycling Systems, Inc., Apr. 12, 1991.

SAC 3002 Literature, SAC Recycling Systems, Inc., Apr. 12, 1991.

*Primary Examiner*—Michael S. Huppert
*Assistant Examiner*—James Keenan
*Attorney, Agent, or Firm*—Malcolm R. McKinnon

[57] ABSTRACT

An apparatus for curbside collection of co-mingled recyclable materials. The apparatus includes a wheel supported frame structure having first and second ends and first and second side portions. A number of receiving bins are positioned along the side portions of the frame structure s as to generally define a longitudinally walkway therebetween. A carriage assembly is mounted to the frame structure to allow movement of the receptacle generally along the walkway. The receptacle has a substantially stationary position where co-mingled recyclable materials are emptied into the receptacle from curbside. Once the receptacle is full, it may be moved along the walkway permitting the co-mingled recyclable materials to be separated and deposited into a receiving bin containing compatible recyclable materials.

11 Claims, 3 Drawing Sheets

CO-MINGLED MATERIAL RECOVERY APPARATUS FOR RECYCLING

BACKGROUND AND SUMMARY OF THE INVENTION

The present invention generally relates to the collection of recyclable materials and more particularly to an apparatus for the curbside collection of co-mingled recyclable materials.

For various reasons, it has become increasingly desirable to recover usable materials from household refuse. Among the reasons which can be cited for this increase is the heightened environmental awareness of the public regarding the decreased availability of raw materials and the decreased availability of land-fill space.

The curbside recovery of recyclable materials such as glass, aluminum and paper is typically performed by having the materials separated into compatible groups for recycling purposes. At the source of the refuse, the household, the recyclable materials are typically separated and stored in containers which must be individually transported to the curbside for scheduled pickup. Requiring the residential customer to separate the recyclable materials often results in decreased participation, particularly in voluntary recycling programs. This decrease in participation may be attributed to the inconvenience experienced by the residential customers in familiarizing themselves with the various types of recyclable materials, the inconvenience in actually separating the recyclable materials, and the inconvenience in carrying a number of recycling bins to the curbside.

Often, while attempting to comply with the separation requirements for curbside pickup, a residential customer will unintentionally combine or co-mingle non-compatible recyclable materials, thus requiring the refuse collector to either refuse pickup or separate the recyclable materials. Unfortunately, present collection vehicles are not designed with the intention of increasing the ease with which the collector can separate co-mingled recyclable materials. Rather, presently available vehicle designs are specifically aimed at utilization of the vehicle with pre-sorted recyclable materials. For this reason, pickup of co-mingled recyclable materials is normally refused.

With the above discussion in mind, it is an object of the present invention to induce a greater public acceptance of recycling programs in general, and voluntary recycling programs in particular. To this end, the present invention seeks to increase the convenience of recycling for the residential customer by providing for the collection of co-mingled recyclable materials. Another object of this invention is to increase the ease with which a collector can pickup co-mingled recyclable materials and separate the recyclable materials according to recycling compatibility.

An additional object of the present invention is to eliminate the need for the residential customer to carry numerous recycling bins to the curbside for collection thereby increasing participation in the recycling program.

It is a further object of the present invention to reduce the start-up cost of a community recycling program by providing an economical alternative to the present collection vehicles. As such, the present invention may be used by an entity in combination with existing vehicles or may be used as a separate and distinct collection vehicle. The apparatus itself is capable of being utilized in either a trailering variety or motorized vehicle variety.

In achieving the above objects, the present invention provides for an apparatus which is an economical solution for implementing curbside recycling programs where the recyclable materials may readily be received in co-mingled state. The apparatus is generally a wheel supported structure having a number of receiving bins longitudinally positioned along its opposing sides. A walkway is generally defined between the receiving bins. A carriage assembly, which includes a receptacle having an opening for receiving the co-mingled recyclable materials, is mounted to permit movement of the receptacle along the walkway.

The carriage assembly includes means for securing the receptacle in a substantially stationary position where it may be easily accessed by the collector permitting the transferring of the co-mingled recyclable materials from the curbside into the receptacle. Once the receptacle becomes filled with co-mingled recyclable materials, the receptacle can be moved by the collector, generally along the walkway, as the collector separates the co-mingled recyclable materials, depositing them into specific receiving bins which contain items that are compatible for recycling purposes.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENTS

Figures 1A, 1B:
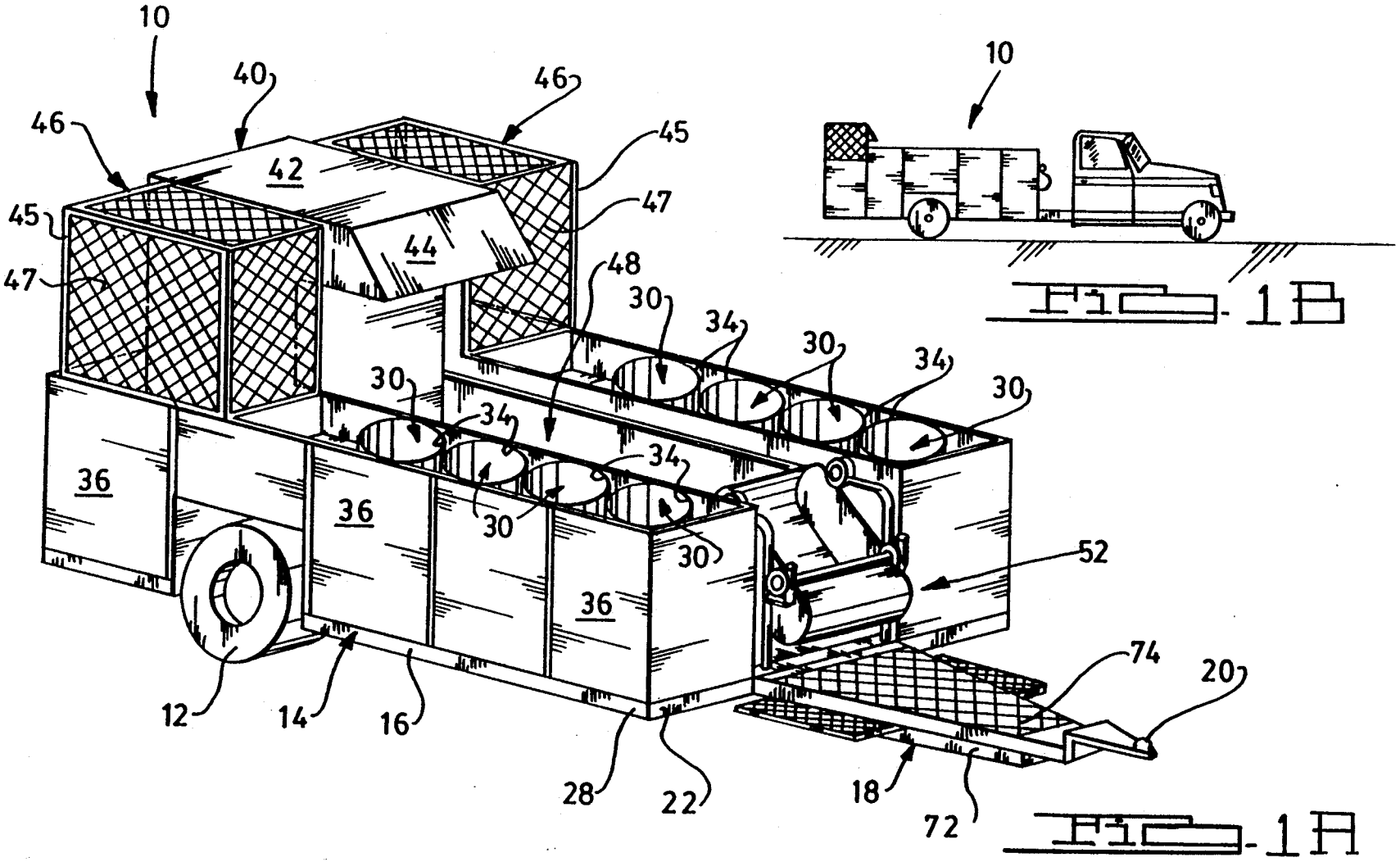
FIG. 1A is a perspective view of an apparatus embodying the principles of the present invention adapted for trailering by another vehicle.
FIG. 1B generally illustrates the principles of the present invention being incorporated into a self-contained motorized vehicle.

Now with reference to the drawing, a material recovery vehicle (MRV) embodying the principles of the present invention is generally illustrated in FIG. 1A and designated at 10. The MRV 10 illustrated in FIG. 1A is of a variety intended to be trailered by a compactor garbage truck or other motorized vehicle. An alternative configuration of the MRV 10, in which the principles of the present invention have been applied to a self-contained motorized vehicle, is generally illustrated in FIG. 1B. It will be appreciated that the following description, while being specifically directed toward a MRV 10 of the trailering variety, has applicability to the alternative embodiment illustrated in FIG. 1B.

With particular reference to FIG. 1A, the MRV 10 is supported on wheels 12 and includes a frame structure 14 which generally having a support deck 16 on which the remaining features of the invention are generally positioned. The frame structure 14 is mounted to the wheels 12 through a typical axle and suspension assembly (not shown). A tongue 18 extends forward from one end of the frame structure 14, and is provided with a cup receiver 20 for mounting to a ball hitch (not shown) of a vehicle. Alternative hitch assemblies could also be employed. Thus, the frame structure 14 generally defines the MRV 10 as including a forward end 22, a rearward end 24, a left side 26 and a right side 28.

Laterally mounted to the support deck 16, generally along the sides 26 and 28 of the MRV 10, are a number of receiving bins 30. While four bins 30 are illustrated as being provided along each side 26 and 28, a greater or lesser number bins 30 can be provided if necessary or desired The receiving bins 30 are positioned in side-by-side relation to one another along the sides 26 and 28 of the MRV 10 and are mounted or positioned on the support deck 16 so as to readily permit the emptying of their contents as needed. In the illustrated embodiment, the receiving bins 30 are shown as being drums, with openings 34 defined at their uppermost end, resting upon the support deck 16 in a generally unattached manner. While the preferred embodiment is illustrated as employing removable drums it is readily apparent that the present invention may be equipped with receiving bins 30 that are attached to the support deck 16 and provided with an alternate means for being emptied.

Positioned outward of the bins 30, along the left and right sides 26 and 28, are removable sidewalls 36 which may be formed by a number of removable panels. The sidewalls 36 assist in maintaining the bins 30 on the MRV 10 as it is being transported and also provide the MRV 10 with a more acceptable, aesthetically pleasing appearance. As will be further discussed below, once the receiving bins 30 of the MRV 10 become filled with recyclable materials, the MRV 10 is taken to a recycling station where the sidewalls 36 are removed and the receiving bins 30 easily handled for emptying of their contents.

Additional bins are transversely mounted along the rearward end 24 of the MRV 10. The additional bins include a center bin 40 which has a top cover 42 and a hooded opening 44. The center bin 40 is designed for receiving newsprint cardboard and other recyclable paper products which need to be kept dry so as to maintain their recyclability.

Immediately adjacent to both sides of the center bin 40 are caged bins 46. The caged bins 46 are "oversized" and generally extend above the sidewalls 36 of the MRV 10. The caged bins 46 include upright supports 45 bounded by a nylon or other type of mesh screen. These bins 46 are designed for receiving plastic containers and the like, which need not be protected from weather, but which are substantially bulky and require an increased amount of storage space.

To facilitate the efficient collection of co-mingled recyclable materials, the MRV is provided with a central walkway 48 that is generally defined between the receiving bins 30 on the left and right sides 26 and 28 of the MRV 10. The walkway 48 extends longitudinally along the MRV 10 from the forward end 22 toward the rearward end 24. The walkway 48 is preferably provided with a non-slip floor 50 and, as such, may be constructed from grating or other materials.

Generally designated at 52, a carriage assembly is cooperatively positioned with respect to the walkway 48. The carriage assembly 52 includes a carriage bin or receptacle 54 which is mounted for general movement along the walkway 48. An opening 56 is defined in the receptacle 54 through which comingled recyclable materials may be deposited into the cavity of the receptacle 54. The receptacle 54 is mounted on guide rails 58 which extend longitudinally along the opposing sides of the walkway 48. Cooperating with the guide rails 58, two pairs of rollers 60 permit the receptacle 54 to be moved between the receiving bins 30 along the walkway 48 from the forward end 22 toward rearward end 24 of the MRV 10. One set of rollers 60 is mounted to the rearward edge 62 of the receptacle while a second pair of rollers 60 is mounted generally toward the forward end 64 of the receptacle 54.

Figure 2:
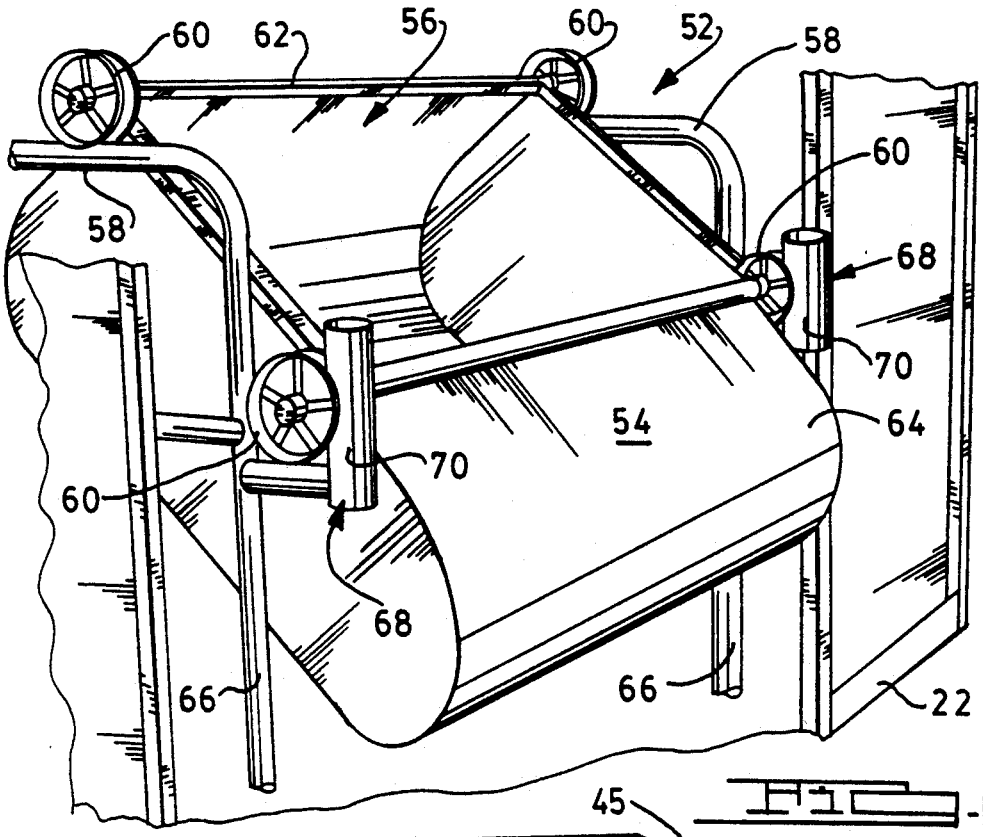
FIG. 2 is a perspective view illustrating the receptacle of the carriage assembly in its loading position.
Figure 3:
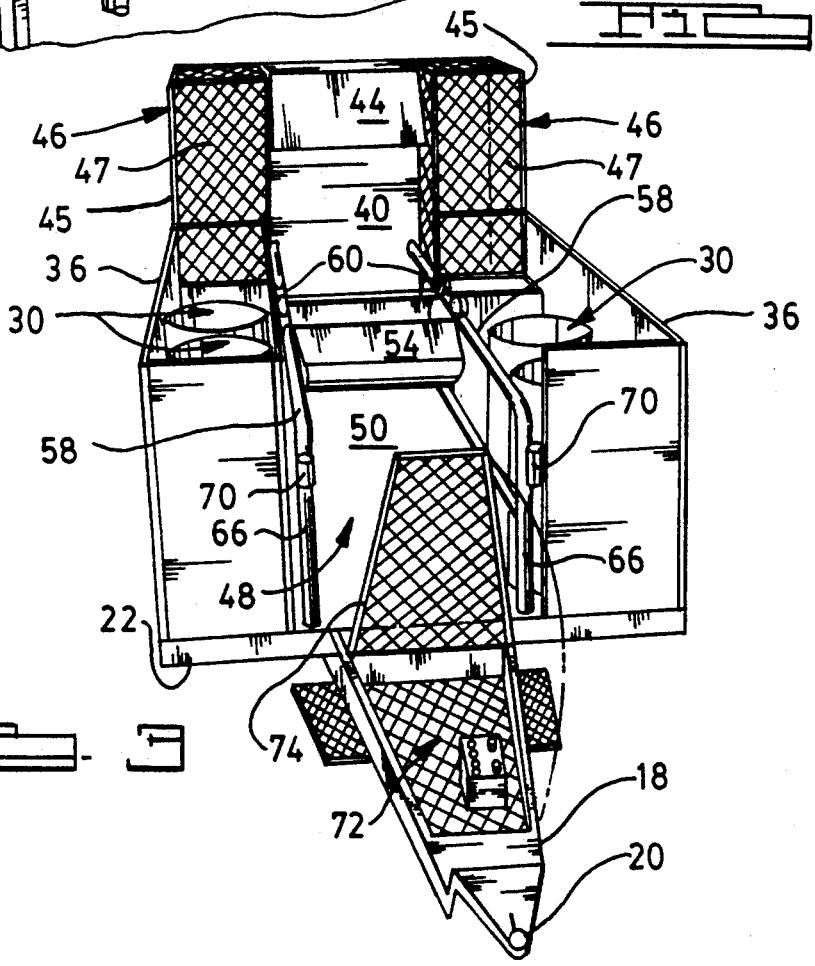
FIG. 3 is a perspective view illustrating the receptacle in its unloading position and being generally moved along the walkway.
Figure 4:
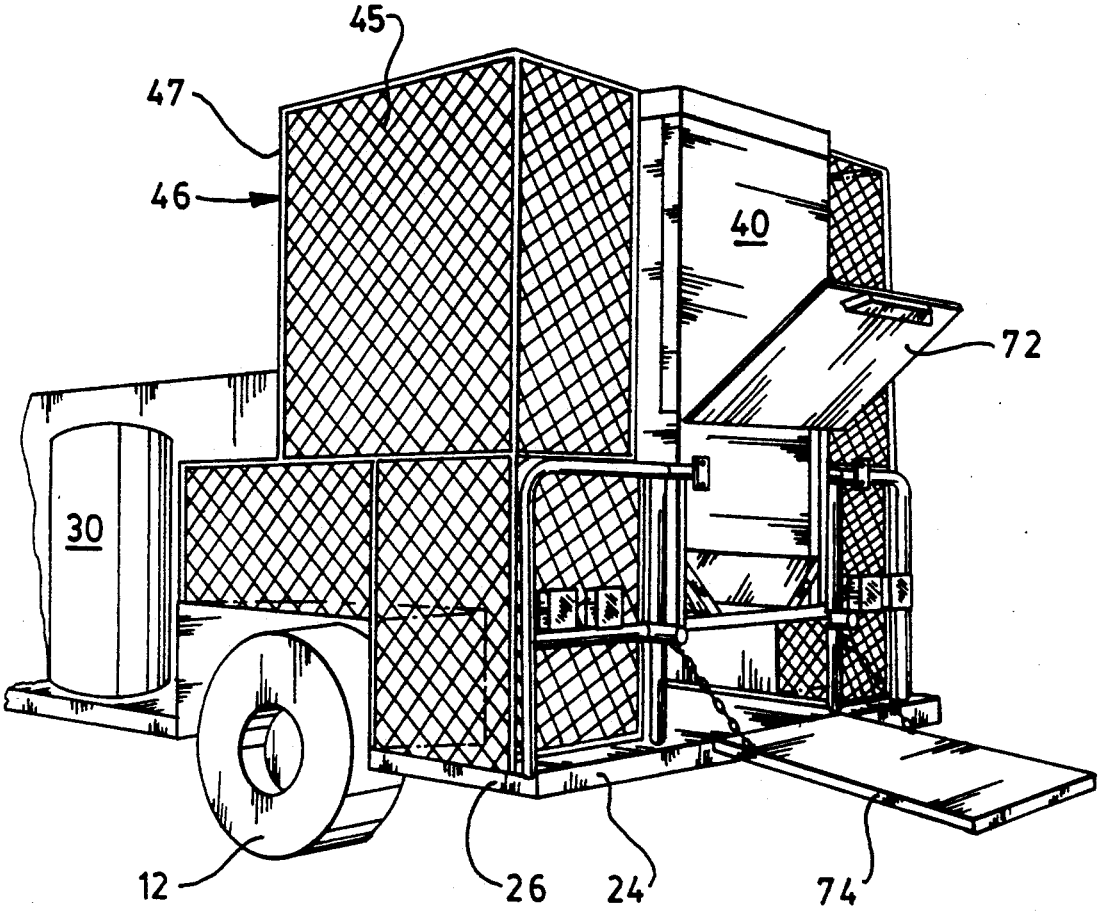
FIG. 4 is a perspective rear view of the apparatus illustrated in FIG. 1 showing the means by which two of the receiving bins may be accessed for removal of the recyclable materials contained therein.

The guide rails 58 are also provided with a mechanism for holding the receptacle 54 in a substantially stationary position. This stationary or loading position is illustrated in FIGS. 1A and 2. The receptacle 54 is held in this position as co-mingled recyclable materials are being collected and transferred thereinto. To retain the receptacle 54 in its stationary position, a downward portion 66 of the guide rails 58, adjacent to the forward end 22 of the support deck 16, is provided with cradle or hook portions 68. The cradles 68 extends horizontally from the downward portions 66 of the guide rails 5 and terminate in generally upwardly extending free ends 70. When secured in its stationary position, the forward set of rollers 60 of the receptacle 54 are nested within the cradle 68 while the rearward set of rollers 60 will rest upon the guide rails 58. In this position, general movement of the receptacle 54 is prevented until the forward set of rollers 60 are lifted up and out of the cradles 68 and positioned on the upper or horizontal portions of the guide rails 58.

When operating the MRV 10, containers holding co-mingled recyclable materials are picked up by the collector from the curbside and the co-mingled recyclable materials are transferred into the receptacle 54. The opening 56 of the receptacle 54 is provided at a height such that, in its stationary position, the collector is not required to significantly raise the curbside container in order to deposit the co-mingled recyclable materials into the receptacle 54. Preferably, the opening 56 of the receptacle 54 is held in its stationary position by the cradles 68 at about waist level.

The receptacle 54 is provided with a volume that will permit several stops along the curbside route before requiring emptying. Once the receptacle 54 becomes filled with co-mingled recyclable materials, the operator climbs upon the tongue 18, which is an extension of the walkway 48, and lifts the receptacle 54 out of the cradles 68 so that the receptacle 54 may be moved along the guide rails 58. As the receptacle 54 is moved along the walkway 48 and the guide rails 58, between the receiving bins 30, the comingled recyclable materials contained therein are separated by the collector, and simultaneously deposited into an appropriate receiving bin 30 which contains like materials. In this manner, the collector can systematically work his/her way along the walkway 48 from the forward end 22 of the MRV 10 toward rearward end 24.

The receiving bins 30 may be used for containing materials such as glass, aluminum, tin, and the like. Upon reaching the rearward end of the walkway 48, bulky plastic containers are deposited in the caged bins 46 while newsprint and cardboard are deposited through the hooded opening 44 into the center bin 40.

Once the receptacle 54 has been emptied, it is then returned to its stationary position and the above procedure is repeated.

A well 72, formed in the tongue 18 of the MRV 10, serves to hold heavy/bulky items such as batteries, electric motors and the like. Access to the well is gained through a hinged lid 74.

When the MRV 10 is substantially full and the bins 30, 40 and 46 require emptying, the MRV 10 is taken to a recycling station where the sidewalls 36 are removed and the receiving bins 30, 40 and 46 emptied. Once emptied, the receiving bins 30, 40 and 46 are repositioned on the support deck 16 and the sidewalls 36 remounted to the frame 14. The rearward end 24 of the MRV 10 is provided with hinged doors 72 and 74 that provide access into the center bin 40 and the caged bins 46 for emptying of the content contained therein.

While the above description constitutes the preferred embodiments of the present invention, it will be appreciated that the invention is susceptible to modification, variation and change without departing from the proper scope and fair meaning of the accompanying claims.

We claim:

1. An apparatus for collection of recyclable materials comprising, in combination, a wheel supported frame structure having a first end, a second end, a first side portion an a second side portion;

a first receiving bin being positioned longitudinally along said first side portion of said frame structure and a second receiving bin being positioned longitudinally along said second side portion of said frame structure, said first and second receiving bins including portions defining openings therein for receiving recyclable materials;

a longitudinally extending walkway being generally defined between said first and second receiving bins; and a carriage assembly being mounted to said frame structure, said carriage assembly including a receptacle having portions defining an opening for receiving recyclable materials therein, said carriage assembly also including means for moving said receptacle generally along said walkway from a first position adjacent to said first end toward a second position substantially adjacent to said second end whereby said recyclable materials may be manually separated as said receptacle is moved along said walkway and said recyclable materials respectively deposited in one of said first and second receiving bins containing compatible recyclable materials therein, said moving means including rail members extending longitudinally along opposing sides of said walkway, said moving means including means cooperating with said rail members to permit manual movement of said receptacle generally along said walkway.

2. An apparatus as set forth in claim 1 wherein said first and second receiving bins are removably positioned along said first side portion and said second side portion.

3. An apparatus as set forth in claim 1 wherein a plurality of first receiving bins are positioned along said first side portion.

4. An apparatus as set forth in claim 3 wherein a plurality of second receiving bins are positioned along said second side portion.

5. An apparatus as set forth in claim 1 wherein said walkway is generally centrally defined between said receiving bins.

6. An apparatus as set forth in claim 1 wherein said carriage assembly is substantially positioned between said bins.

7. An apparatus as set forth in claim 1 including means for maintaining said receptacle in a substantially stationary position when in said first position.

8. An apparatus as set forth in claim 1 wherein said apparatus is a trailer.

9. An apparatus as set forth in claim 1 wherein said apparatus is a motor vehicle.

10. A trailering apparatus for curbside collection of co-mingled recyclable materials comprising, in combination, a wheel supported frame structure including a support deck, said frame structure including a first end, a second end, a first side portion and a second side portion;

a plurality of first receiving bins being positioned longitudinally along said first side portion in substantially side-by-side relation to one another, said plurality of first receiving bins including portions defining openings for receiving separated recyclable materials therein;

a plurality of second receiving bins being positioned longitudinally along said second side portion in substantially side-by-side relation to one another, said plurality of second receiving bins also including portions defining openings for receiving separated recyclable materials therein;

a longitudinally extending walkway being generally defined between said plurality of first receiving bins and said plurality of second receiving bins, said walkway extending from said first end toward said second end;

a plurality of third receiving bins being positioned generally transversely along said second end in substantially side-by-side relation to one another, said plurality of third receiving bins including portions defining openings for receiving separated recyclable materials therein; and a carriage assembly including a moveable carriage bin having portions defining an opening for receiving co-mingled recyclable materials, said carriage assembly also including means for moving said carriage bin generally along said walkway from a first position adjacent said first end and a second position generally adjacent said second end, said carriage assembly further including means for securing said carriage bin in a substantially stationary position when in said first position, said co-mingled recyclable materials being receivable into said carriage bin while said carriage bin is in said substantially stationary position and said co-mingle recyclable material being separable for respectively being deposited in one of said plurality of first, second or third receiving bins as said carriage bin is moved along said walkway, said moving means including rail members extending longitudinally along opposing sides of said walkway, said moving means including roller members being mounted to said carriage bin, said roller members cooperating with said rail members to allow movement of said carriage bin generally along said walkway.

11. A trailering apparatus as set forth in claim 10 wherein said securing means is formed on said rail members and includes portions preventing longitudinal movement of said roller members.

* * * * *